US010897973B2

(12) United States Patent
Lee

(10) Patent No.: US 10,897,973 B2
(45) Date of Patent: Jan. 26, 2021

(54) HAIR CURLER

(71) Applicant: Jinwoo Lee, Seoul (KR)

(72) Inventor: Jinwoo Lee, Seoul (KR)

( * ) Notice: Subject to any disclaimer, the term of this patent is extended or adjusted under 35 U.S.C. 154(b) by 95 days.

(21) Appl. No.: 16/087,654

(22) PCT Filed: Mar. 24, 2017

(86) PCT No.: PCT/KR2017/003165

§ 371 (c)(1),
(2) Date: Sep. 23, 2018

(87) PCT Pub. No.: WO2017/175994

PCT Pub. Date: Oct. 12, 2017

(65) Prior Publication Data

US 2019/0082806 A1 Mar. 21, 2019

(30) Foreign Application Priority Data

Apr. 7, 2016 (KR) ..... 10-2016-0042742
Jul. 1, 2016 (KR) ..... 10-2016-0083303

(51) Int. Cl.
*A45D 2/36* (2006.01)
*A45D 1/04* (2006.01)
*A45D 1/10* (2006.01)

(52) U.S. Cl.
CPC ..... *A45D 1/04* (2013.01); *A45D 1/10* (2013.01); *A45D 2/362* (2013.01)

(58) Field of Classification Search
CPC ... A45D 1/04; A45D 1/10; A45D 1/16; A45D 1/08; A45D 2/2414; A45D 2/2457;
(Continued)

(56) References Cited

U.S. PATENT DOCUMENTS 3,935,869 A * 2/1976 Reinsch ..... A45D 24/007 132/271
4,591,695 A * 5/1986 Inoue ..... A45D 1/04 132/232

(Continued)

FOREIGN PATENT DOCUMENTS

JP 11-127944 A 5/1999
KR 10-1311806 B1 9/2013

(Continued)

*Primary Examiner* — Cris L. Rodriguez
*Assistant Examiner* — Brianne E Kalach
(74) *Attorney, Agent, or Firm* — Patent Office of Dr. Chung Park

(57) ABSTRACT

A hair curler includes: a body unit having an electric circuit; a heating unit connectedly fixed to one end portion of the body unit and allowing hair to be wound around on an outer circumferential surface thereof; a rotation unit rotatably provided on one end portion of the heating unit so as to rotate in the circumferential direction of the heating unit, and having one side extendedly formed in the lengthwise direction of the heating unit so as to rotate around the circumference of the heating unit; a hair holding unit attached movably to the extendedly formed one side of the rotation unit in the lengthwise direction of the heating unit, and accommodating the hair wound around the heating unit; and moving means for moving the hair holding unit in the lengthwise direction of the heating unit, such that the hair is spirally wound around the heating unit.

2 Claims, 11 Drawing Sheets

(58) Field of Classification Search
CPC . A45D 2/367; A45D 6/02; A45D 6/04; A45D 6/045; A45D 24/007; A45D 40/262; A45D 40/264; A45D 40/265; A45D 40/267; A45D 2002/006
See application file for complete search history.

(56) References Cited

U.S. PATENT DOCUMENTS

| | | | | |
|---|---|---|---|---|
| 5,765,572 | A * | 6/1998 | Paget | A45D 6/04 132/210 |
| 2007/0278205 | A1* | 12/2007 | Pencook | A45D 2/367 219/222 |
| 2012/0145180 | A1* | 6/2012 | Rong | A45D 1/04 132/227 |
| 2016/0007709 | A1 | 1/2016 | Newman | |

FOREIGN PATENT DOCUMENTS

| | | | |
|---|---|---|---|
| KR | 10-1453723 | B1 | 10/2014 |
| KR | 10-2016-0041393 | A | 4/2016 |
| KR | 10-1677879 | B1 | 11/2016 |
| WO | 2014-122203 | A1 | 8/2014 |

* cited by examiner

HAIR CURLER

CROSS-REFERENCE TO PRIOR APPLICATIONS

This application is a national Stage Patent Application of PCT International Patent Application No. PCT/KR2017/003165, filed on Mar. 24, 2017 under 35 U.S.C. § 371, which claims priority of Korean Patent Application Nos. 10-2016-0042742, filed on Apr. 7, 2016 and 10-2016-0083303, filed on Jul. 1, 2016, which are all hereby incorporated by reference in their entirety.

TECHNICAL FIELD

The present invention relates to a hair curler, and more particularly, to a hair curler that allows hair to be conveniently rolled around a heating unit, thereby easily achieving a desired hairstyle within a short time.

BACKGROUND ART

Generally, a hair iron as one of hair cosmetic tools has been widely used to make various hairstyles, for example, to straighten curled hair or to curl straightened hair.

A conventional hair iron for curling hair to a wavy hairstyle is configured to allow hair to be directly held by a user and thus to wind the hair around the hair iron, and in this case, several winding and curing operations for the corresponding hair should be carried out, so that during the operations for a long time, the hair may be damaged due to the heat exceeding appropriate heat quantity required for the curling. Further, the user's arm and wrist may be easily fatigued, and also, he or she may be burned.

DISCLOSURE

Technical Problem

Accordingly, the present invention has been made in view of the above-mentioned problems occurring in the prior art, and it is an object of the present invention to provide a hair curler that is capable of rotating a hair holding unit for accommodating hair therein in the circumferential direction of a heating unit and moving the hair holding unit in the lengthwise direction of the heating unit, thereby allowing the hair to be wound around the heating unit.

Technical Solution

To accomplish the above object, according to the present invention, there is provided a hair curler including: a heating unit connected to a body unit in which an electric circuit is built and allowing hair to be wound around an outer circumferential surface thereof; a rotation unit disposed close to one end portion of the heating unit so as to rotate in the circumferential direction of the heating unit; a support unit coupled to the rotation unit to rotate around the circumference of the heating unit; a hair holding unit attached movably to the support unit in the lengthwise direction of the heating unit and accommodating the hair wound around the heating unit therein; and a moving means for moving the hair holding unit in the lengthwise direction of the heating unit.

According to the present invention, desirably, the hair holding unit rotates in the circumferential direction of a heating unit and moves in the lengthwise direction of the heating unit, at the same time, so that the hair can be spirally wound around the heating unit.

Advantageous Effects

According to the present invention, the hair curler can wind the hair around the heating unit quickly to reduce hair styling time, thereby minimizing the damage of the hair.

Further, the hair curler according to the present invention can wind the hair around the heating unit conveniently, thereby preventing a user's arm and wrist from being easily fatigued.

DESCRIPTION OF DRAWINGS

FIG. 9*a* is an enlarged perspective view showing an operating process wherein a rotation unit 130 rotates in a first direction.

FIG. 9*b* is an enlarged perspective view showing a process wherein one side of the hair holding unit 140 extended in the longitudinal direction of the heating unit 120 moves a transferring part 401 to a winding part 201.

FIG. 9*c* is an enlarged perspective view showing a process wherein at the time when the rotation unit 130 rotates in a second direction, the rotating and moving part 404 escapes from a first protrusion 401*a* of the transferring part 401.

FIG. 9*d* is an enlarged perspective view showing a process wherein the hair holding unit 140 moving in the longitudinal direction of the heating unit 120 by means of the rotation unit 130 rotating in the second direction is ready to return to a start position before hair styling and the transferring part 401 moves to its original position by means of a transferring part elastic member 402.

BEST MODE FOR INVENTION

Hereinafter, an explanation on a hair curler according to the present invention will be in detail given with reference to the attached drawings.

Figure 1A:
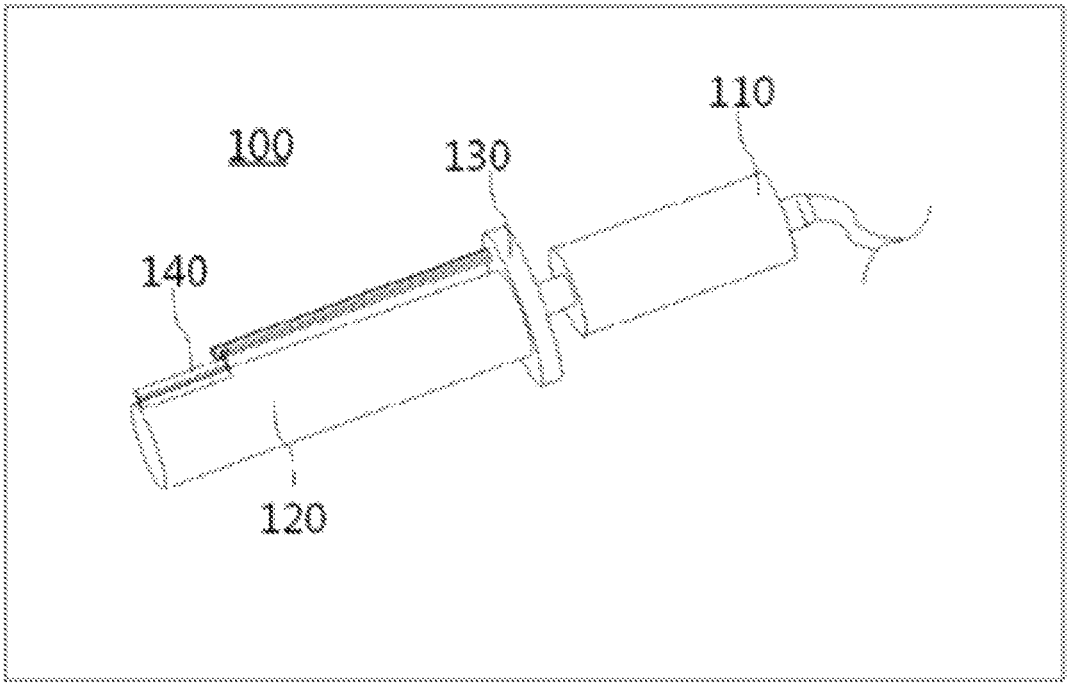
FIG. 1*a* is a perspective view showing a hair curler 100 according to the present invention, wherein a moving means for moving a hair holding unit 140 in a longitudinal direction of a heating unit 120 is not shown.
Figure 1B:
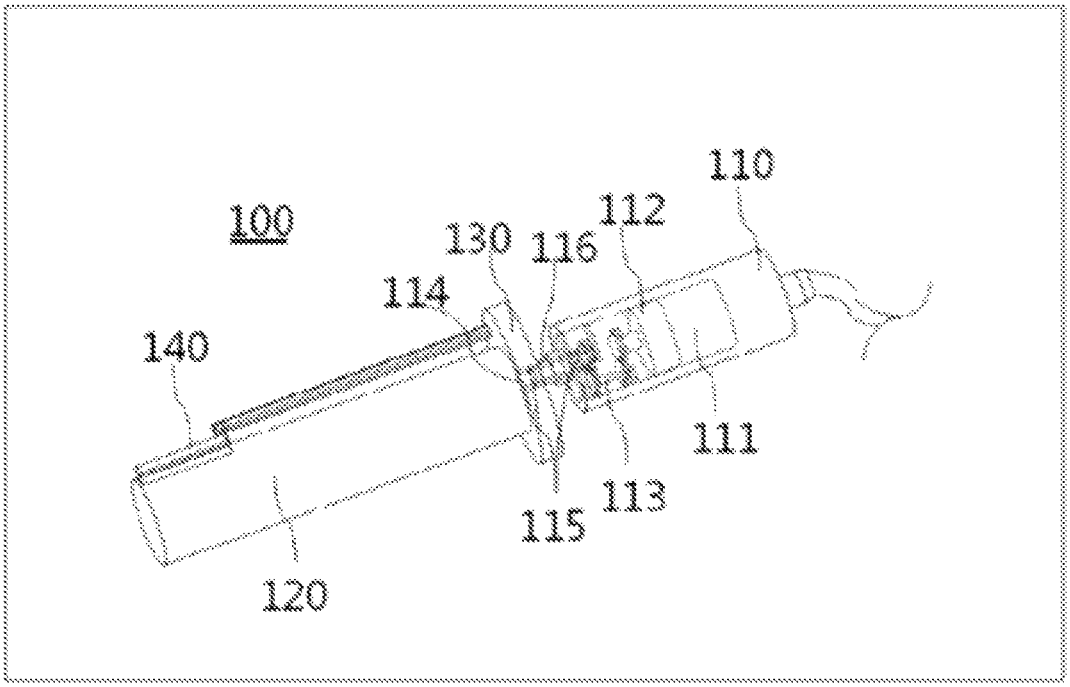
FIG. 1*b* is a perspective view showing the hair curler 100 according to the present invention, wherein a driving unit is built in a body unit 110.
Figure 1C:
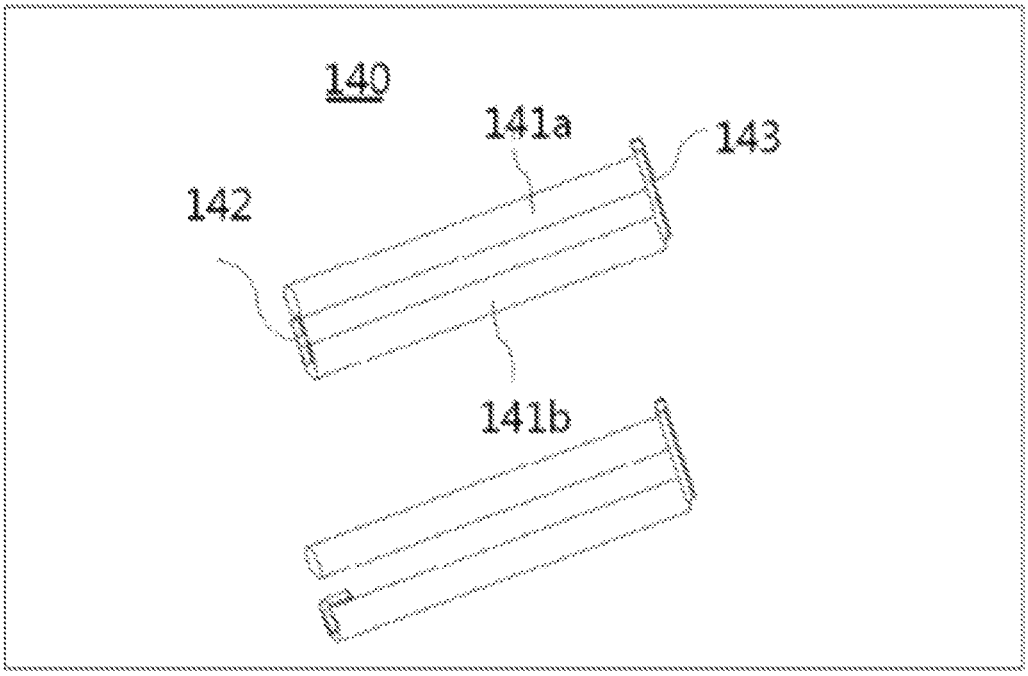
FIG. 1*c* is an enlarged perspective view showing the hair holding unit 140 of FIG. 1*a*.
Figure 2:
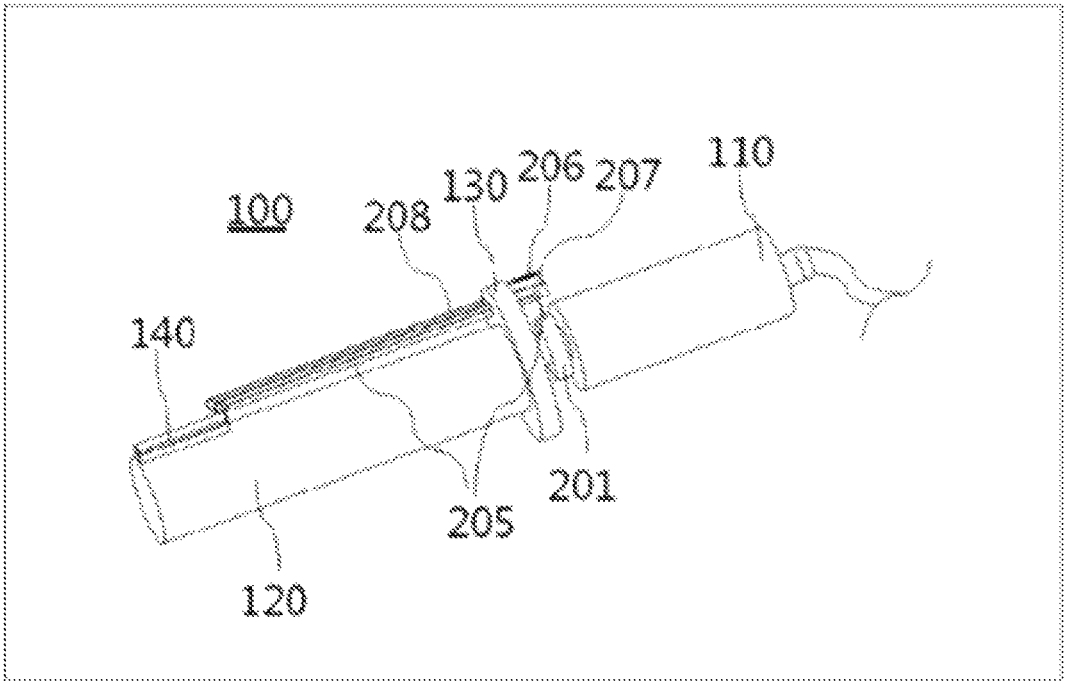
FIG. 2 is a perspective view showing an example of the moving means in the hair curler 100 according to the present invention.
Figure 3A:
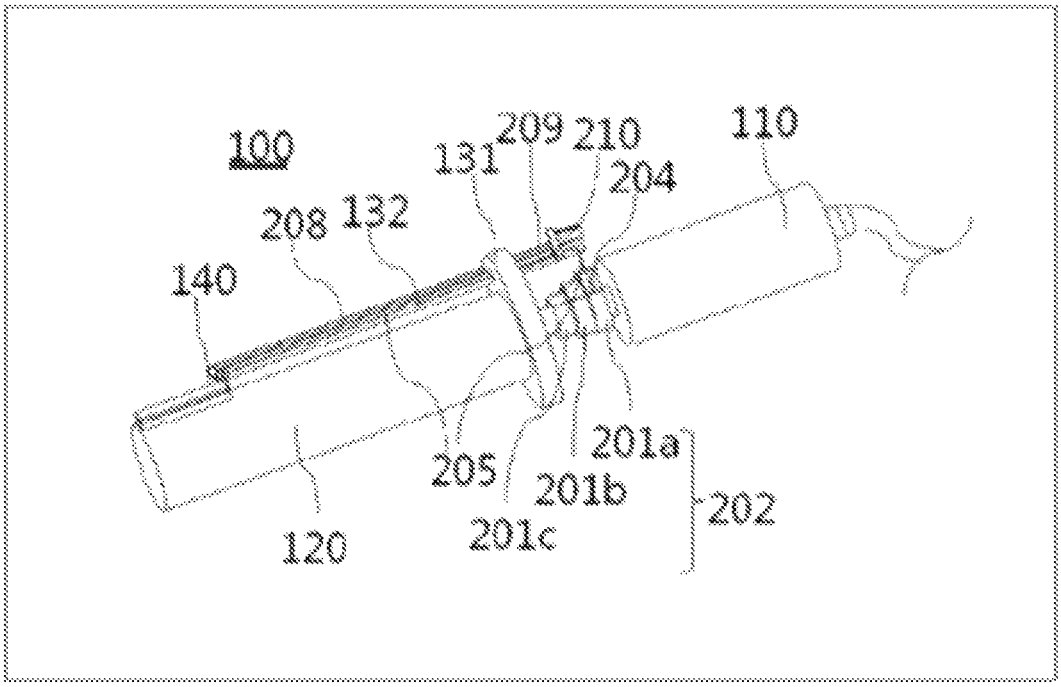
FIG. 3*a* is a perspective view showing another example of the moving means in the hair curler 100 according to the present invention.
Figure 3B:
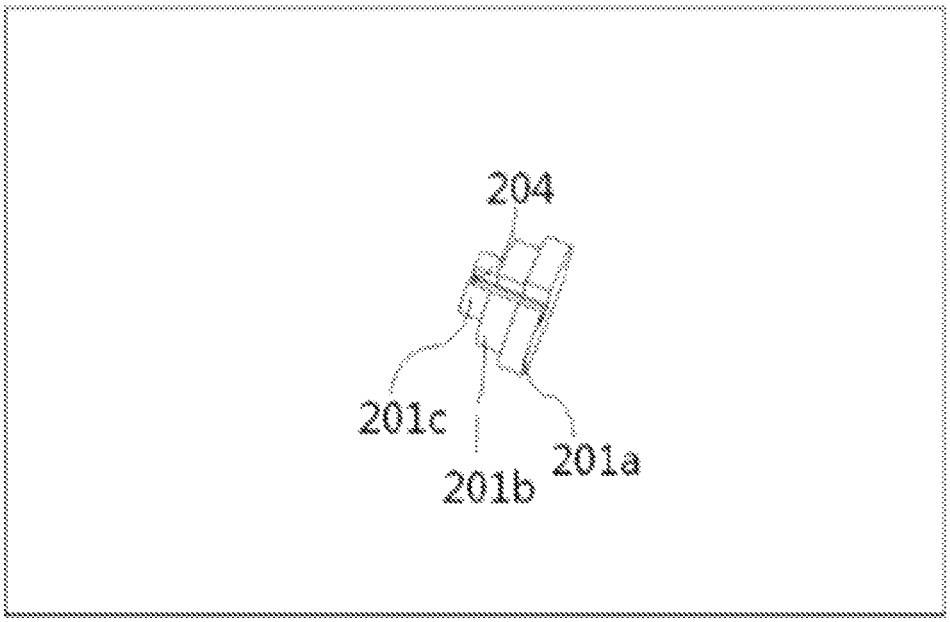
FIG. 3*b* is an enlarged perspective view showing a winding part assembly 202 of FIG. 3*a*.

As shown in FIG. 2, a hair curler 100 according to the present invention includes a body unit 110 in which an electric circuit (not shown) is built; a heating unit 120 connectedly fixed to one end portion of the body unit 110 and allowing hair to be wound around an outer circumferential surface thereof; a rotation unit 130 rotatably provided on one end portion of the heating unit 120 so as to rotate in the circumferential direction of the heating unit 120, and having one side extendedly formed in the lengthwise direction of the heating unit 120 so as to rotate around the circumference of the heating unit 120; and a hair holding unit 140 attached movably to one side of the rotation unit extendedly formed in the lengthwise direction of the heating unit 120, and accommodating the hair wound around the heating unit 129 therein.

A moving means for moving the hair holding unit 140 in the lengthwise direction of the heating unit 120 has various examples in the hair curler 100 according to the present invention, and as shown in FIG. 2, first, the moving means includes: a winding wire member 205 having one end connected to the hair holding unit 140 and the other end fixed to a winding part 201 as will be discussed later via one side of the rotation unit 130 extended in the lengthwise direction of the heating unit 120; and the winding part 201 disposed on one end portion of the body unit 110 to allow one side of the rotation unit 130 extended in the lengthwise direction of the heating unit 120 to rotate around the circumference of the heating unit 120 and thus to allow the winding wire member 205 to be wound therearound at the time of the rotation of the rotation unit 130.

One side of the rotation unit 130 extended in the lengthwise direction of the heating unit 120 may be extended toward the body unit 110, as well. Accordingly, one side of the rotation unit 130 extended can rotate around the circumference of the heating unit 120 as well as the circumference of the winding part 201 disposed on one end portion of the body unit 110.

While one side of the rotation unit 130 extended in the lengthwise direction of the heating unit 120 is rotating, therefore, the winding wire member 205 is wound around the winding part 201, so that the hair holding unit 140 attached to one side of the rotation unit 130 extended in the lengthwise direction of the heating unit 120 moves in the lengthwise direction of the heating unit 120 by the length of the winding wire member 205 wound around the winding part 201. For example, if one side of the rotation unit 130 extended in the lengthwise direction of the heating unit 120 rotates one time around the circumference of the heating unit 120, the winding wire member 205 is also wound once around the winding part 201. The hair holding unit 140 moves in the lengthwise direction of the heating unit 120 by the length of the winding wire member 205 wound around the winding part 201, and so as to prevent the hair spirally wound around the heating unit 120 from being overlaid, accordingly, a length of the circumference of the winding part 201 is determined upon a width of the hair accommodated in the hair holding unit 140. Accordingly, the hair curler as shown in FIG. 2 is the best in shape.

MODE FOR INVENTION

Figure 4:
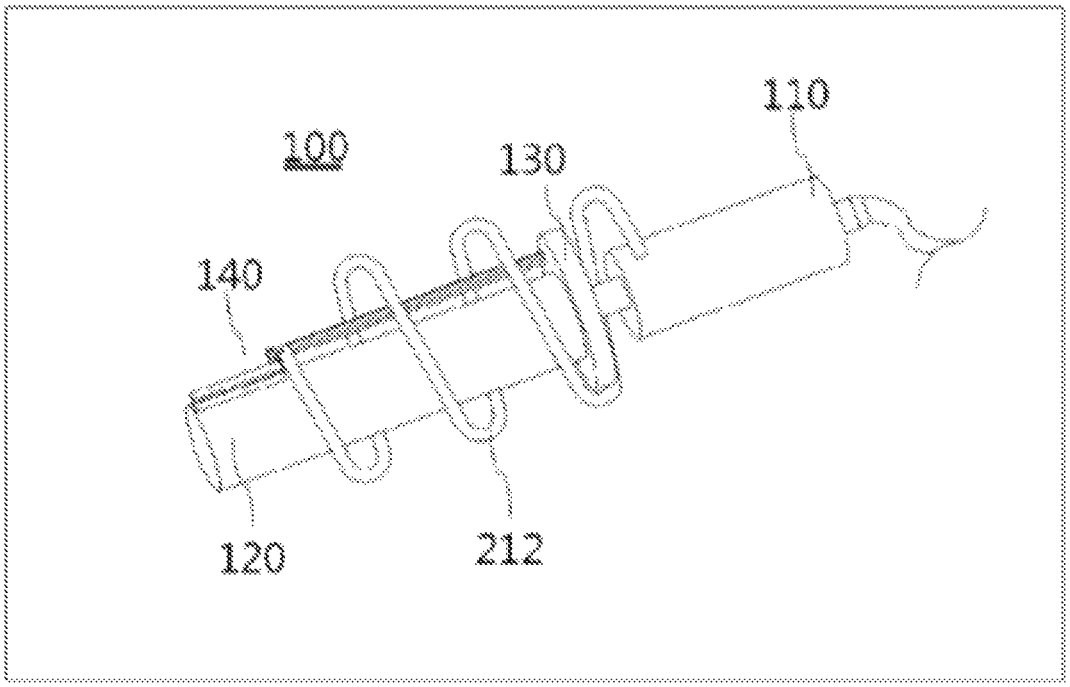
FIG. 4 is a perspective view showing yet another example of the moving means in the hair curler 100 according to the present invention.

FIG. 4 is a perspective view showing yet another example of the moving means in the hair curler 100 according to the present invention.

The moving means includes a spaced spiral guide unit 212 spaced apart from the heating unit 120 to spirally surround the heating unit 120 and having one end portion fixed to one side of the body unit 110, and one side of the hair holding unit 140 is extended toward the spaced spiral guide unit 212 in such a manner as to be movably attached to the spaced spiral guide unit 212. While the rotation unit 130 is rotating, accordingly, the hair holding unit 140 moves along the spaced spiral guide unit 212 to allow the hair to be spirally wound around the heating unit 120. The spaced spiral guide unit 212 is spirally extended toward the lengthwise direction of the heating unit 120 so as to allow the hair holding unit 140 to guidedly move in the lengthwise direction of the heating unit 120 while the rotation unit 130 is rotating. Any one of the spaced spiral guide unit 212 and one side extended of the hair holding unit 140 has a protrusion toward the other, and the other has a groove fittedly coupled to the protrusion. While the rotation unit 130 is rotating, accordingly, the hair holding unit 140 moves along the spaced spiral guide unit 212.

Figure 5:
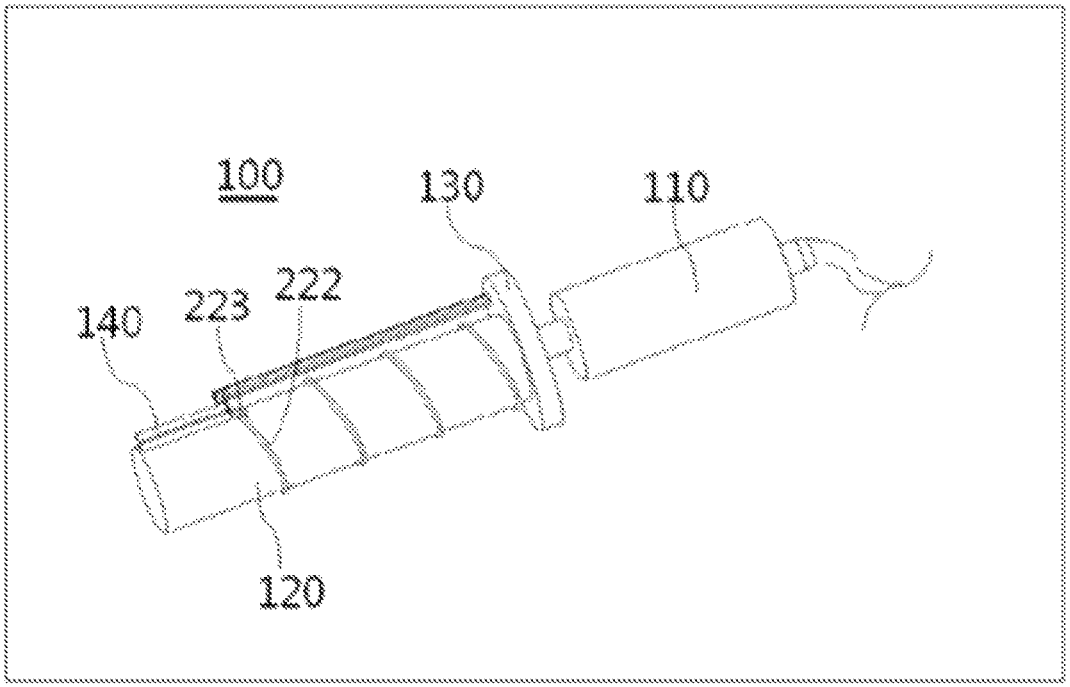
FIG. 5 is a perspective view showing still another example of the moving means in the hair curler 100 according to the present invention.
Figure 6A:
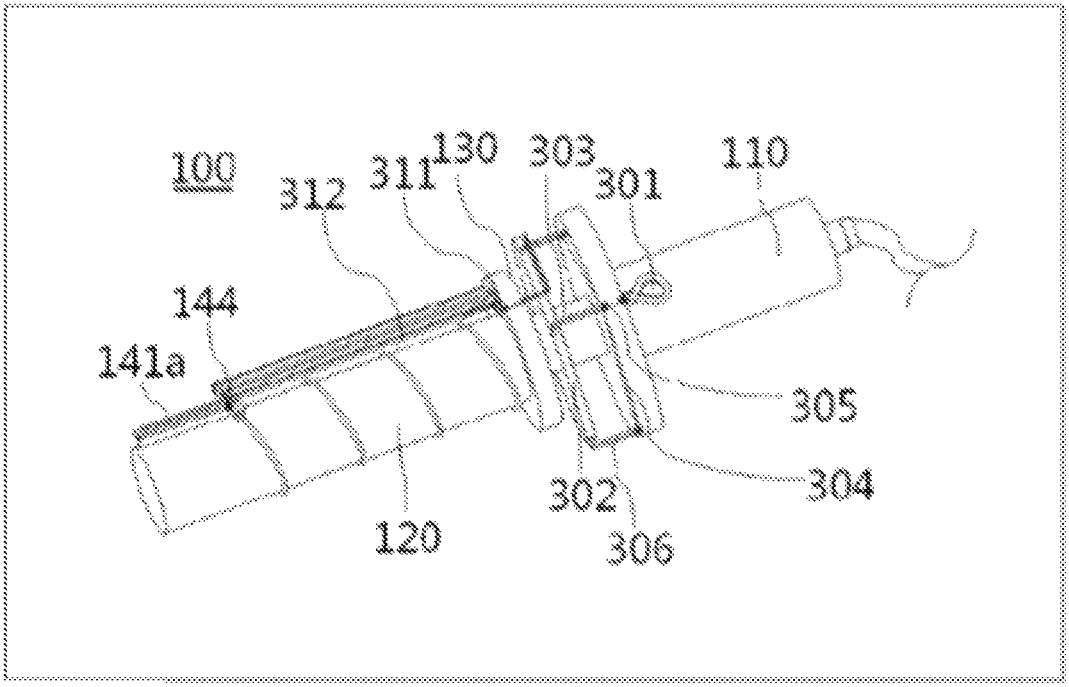
FIG. 6*a* is a perspective view showing an example for the separation of the hair holding unit 140 in the hair curler 100 according to the present invention.
Figure 6B:
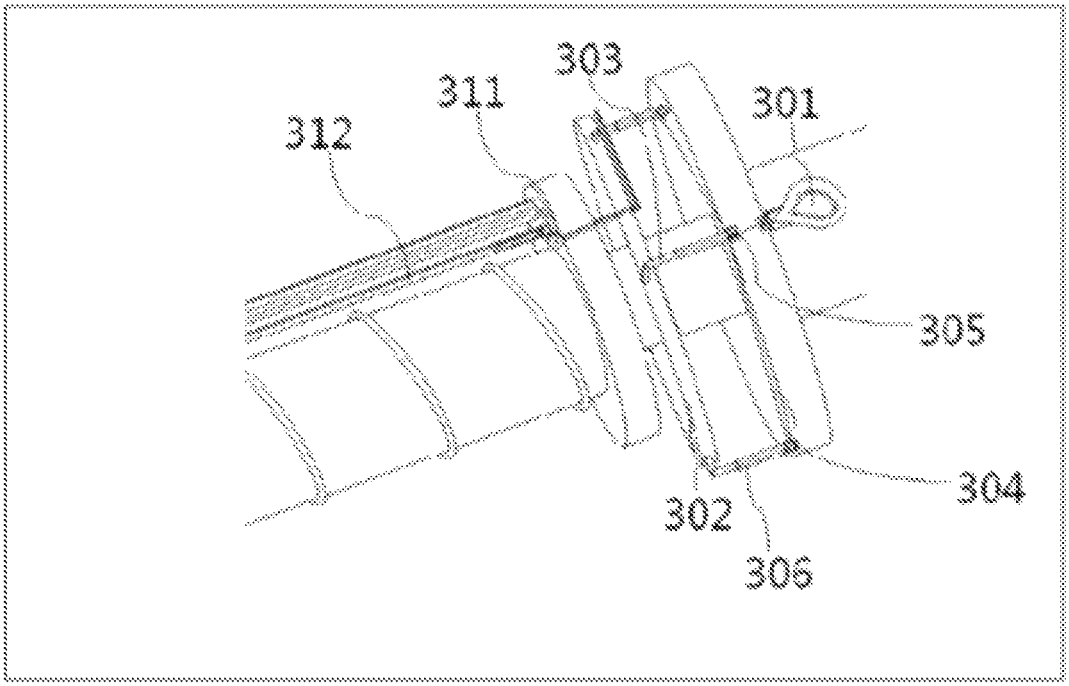
FIG. 6*b* is a partially enlarged perspective view of FIG. 6*a*.
Figure 7A:
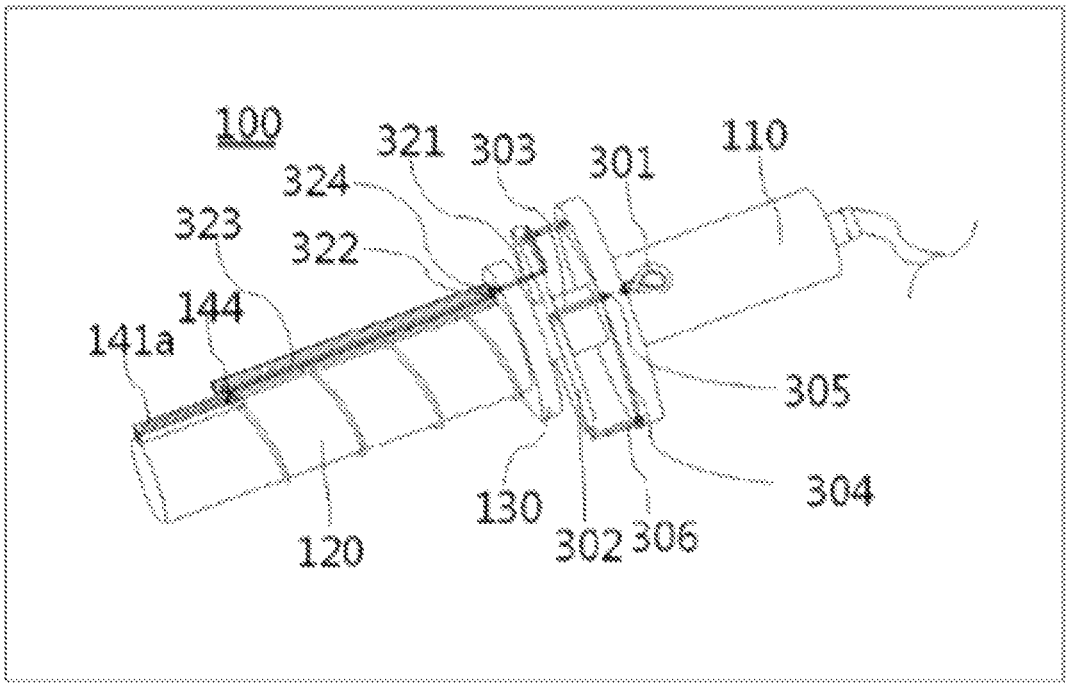
FIG. 7*a* is a perspective view showing another example for the separation of the hair holding unit 140 in the hair curler 100 according to the present invention.
Figure 7B:
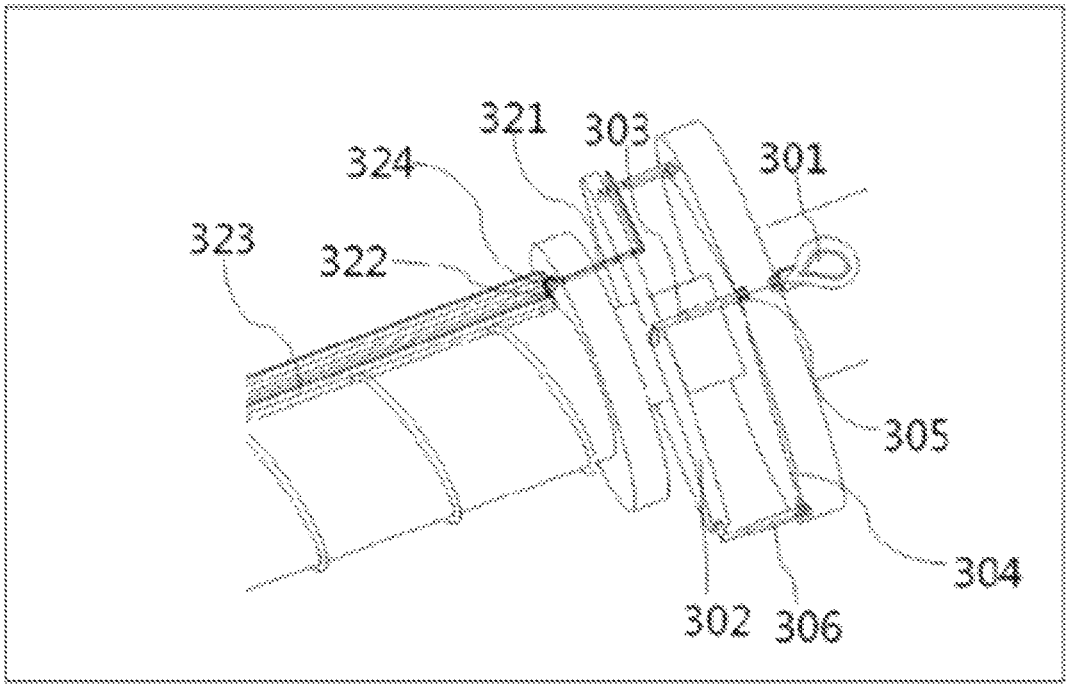
FIG. 7*b* is a partially enlarged perspective view of FIG. 7*a*.
Figure 8:
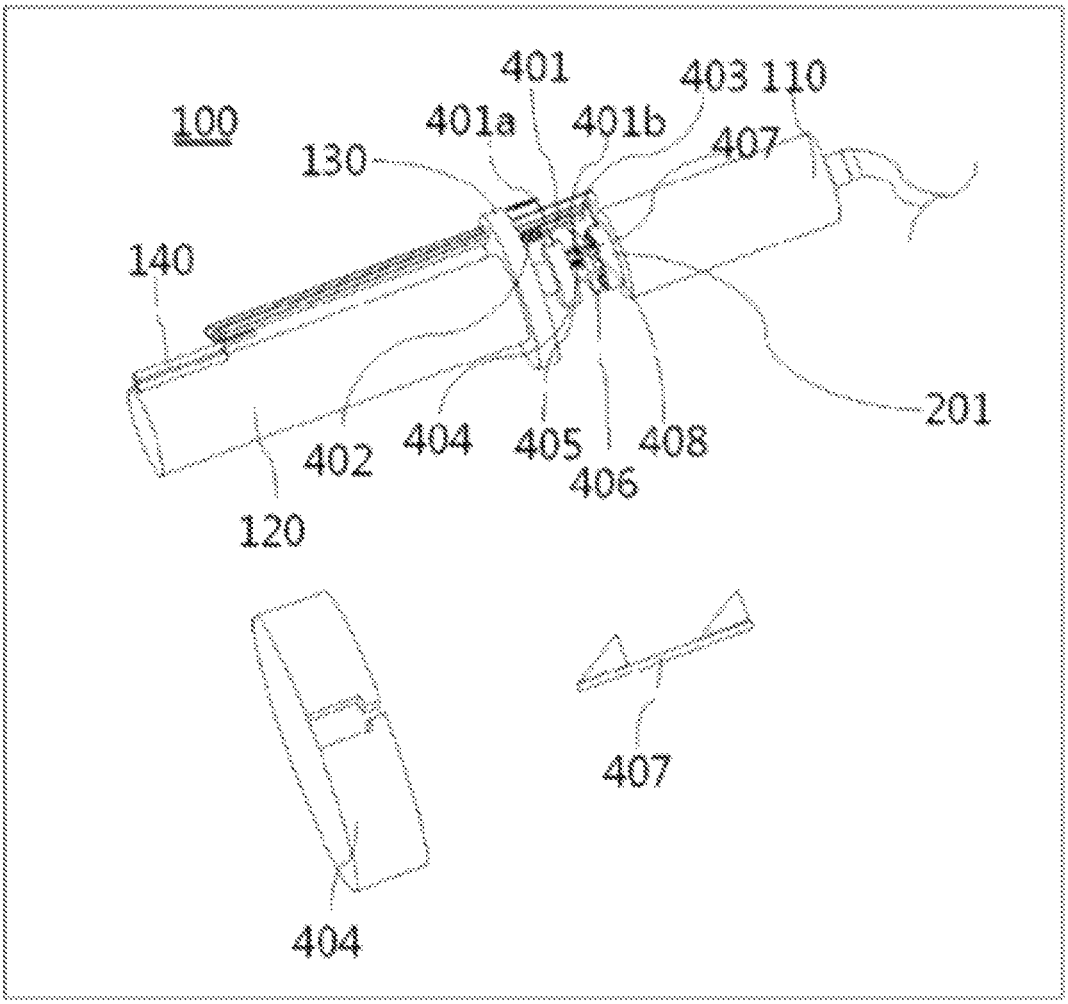
FIG. 8 is a perspective view showing the hair holding unit 140 just rotating around the heating unit 120 at the time when it reaches a given point, while being not moved to the longitudinal direction of the heating unit 120, and an enlarged perspective view showing a rotating and moving part 404 and a locking part 407.
Figure 9A:
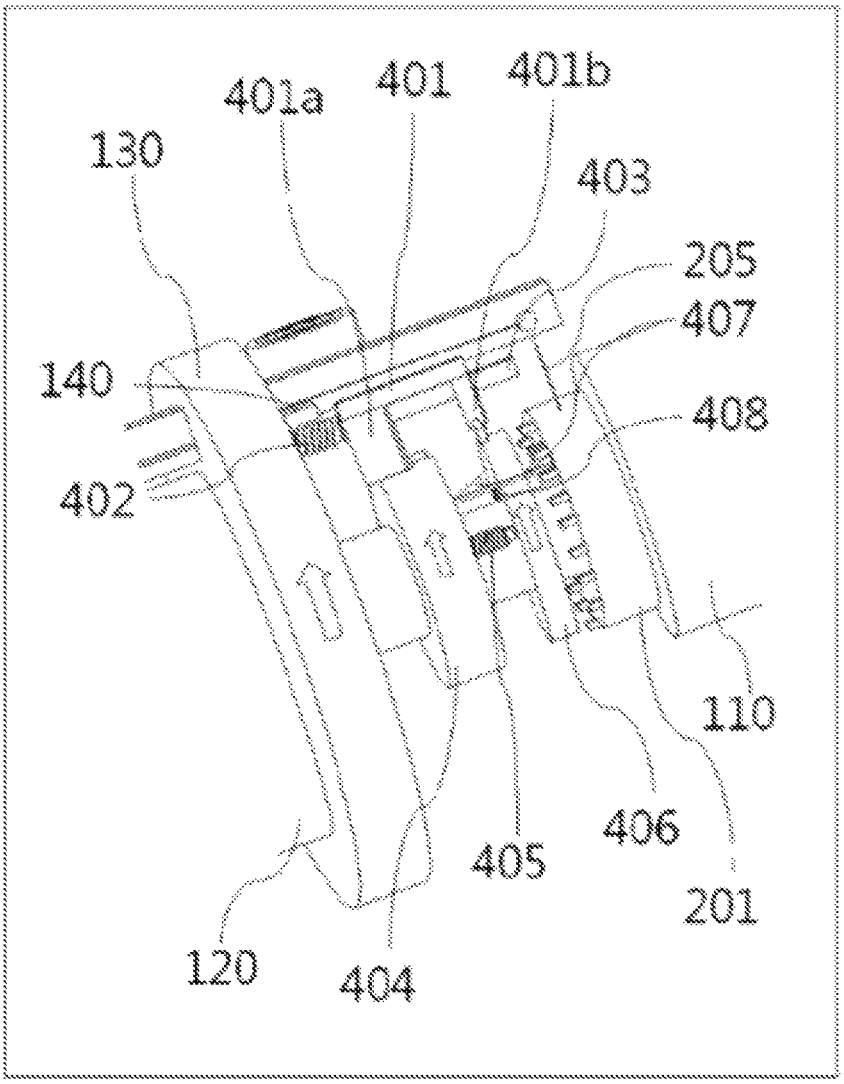
FIG. 9*a* to 9*d* are partially enlarged perspective views showing the components of the hair curler 100 configured to have the hair holding unit 140 just rotating around the heating unit 120 at the time when it reaches a given point, while being not moved to the longitudinal direction of the heating unit 120.
Figure 9B:
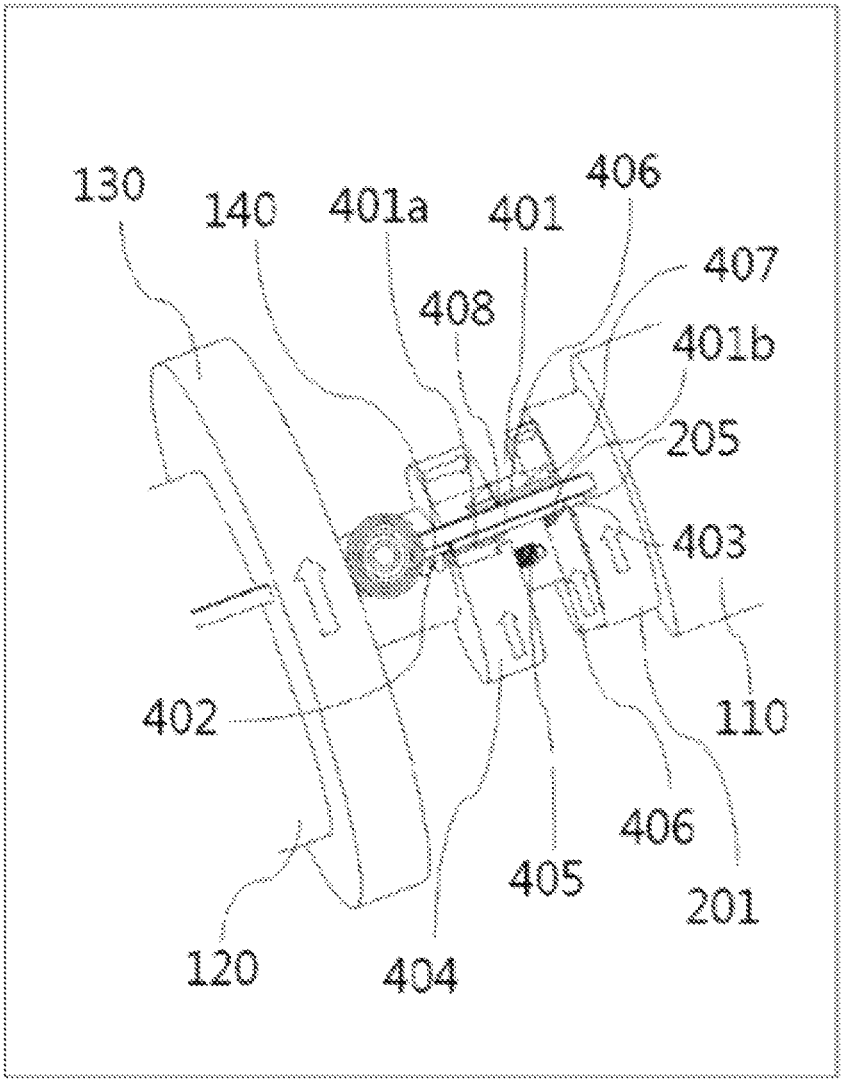
Figure 9C:
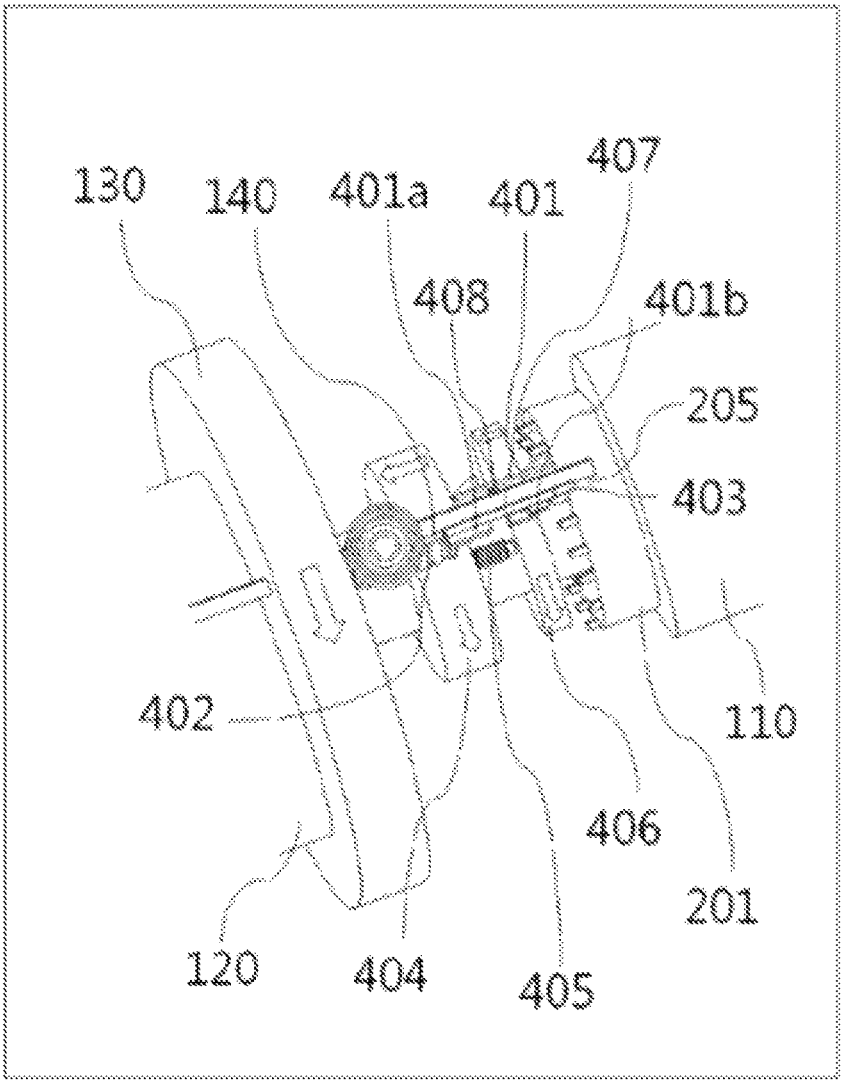
Figure 9D:
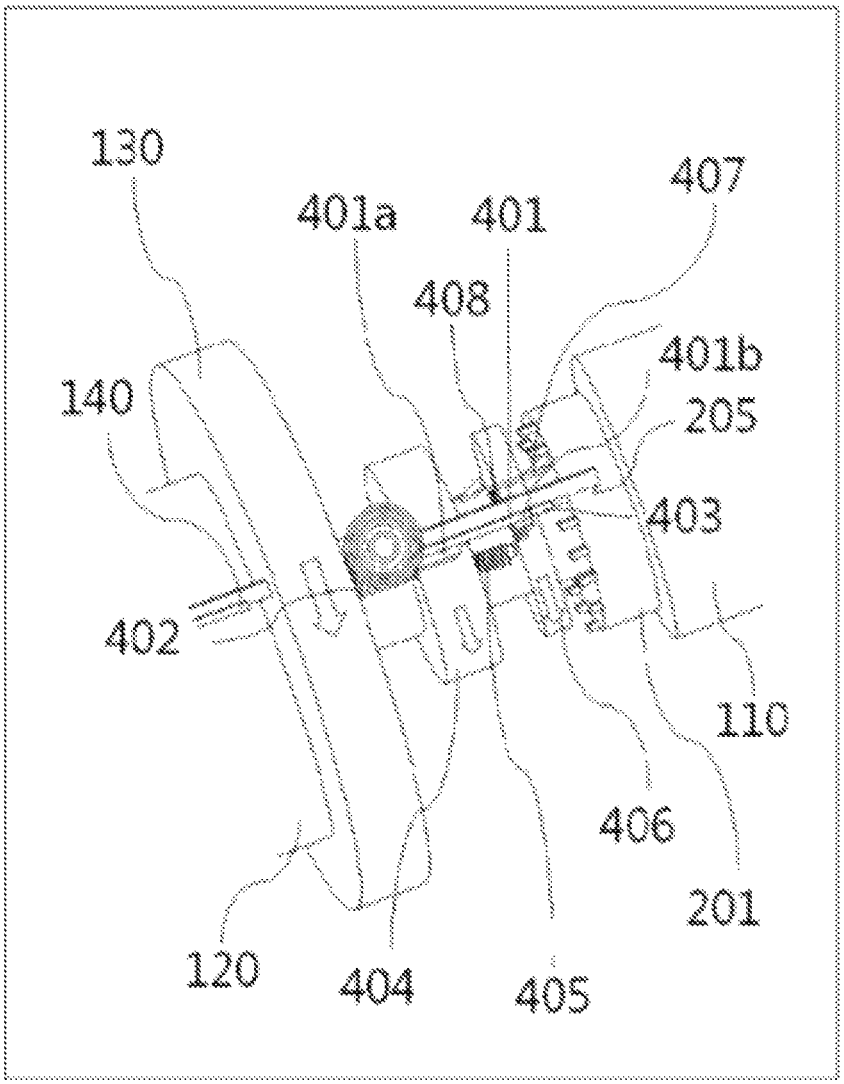

According to the present invention, the moving means as shown in FIG. 5 includes a contacted spiral guide unit 222 spirally disposed around the outer circumference of the heating unit 120, and one side of the hair holding unit 140 is extended toward the contacted spiral guide unit 222 in such a manner as to be movably attached to the contacted spiral guide unit 222. While the rotation unit 130 is rotating, accordingly, the hair holding unit 140 moves along the contacted spiral guide unit 222 to allow the hair to be spirally wound around the heating unit 120.

The contacted spiral guide unit 222 is disposed around the outer circumference of the heating unit 120 in such a manner as to be spirally extended toward the lengthwise direction of the heating unit 120 so as to allow the hair holding unit 140 to move in the lengthwise direction of the heating unit 120 while the rotation unit 130 is rotating. Any one of the contacted spiral guide unit 222 and one side extended of the hair holding unit 140 has a protrusion toward the other, and the other has a groove fittedly coupled to the protrusion. While the rotation unit 130 is rotating, accordingly, the hair holding unit 140 moves along the contacted spiral guide unit 222.

INDUSTRIAL APPLICABILITY

According to the present invention, the hair curler can wind the hair around the heating unit quickly to reduce hair styling time, thereby minimizing the damage of the hair. Further, the hair curler according to the present invention can wind the hair around the heating unit conveniently, thereby preventing a user's arm and wrist from being easily fatigued.

Accordingly, the hair curler according to the present invention can be attractive to persons who want to curl their hair easily and safely, thereby providing excellent industrial applicability and commerciality.

The invention claimed is:

1. A hair curler comprising:

a body unit having an electric circuit built therein;

a heating unit connectedly fixed to one end portion of the body unit and allowing hair to be wound around an outer circumferential surface thereof;

a rotation unit rotatably provided on one end portion of the heating unit so as to rotate in a circumferential direction of the heating unit and having one side extendedly formed in a lengthwise direction of the heating unit so as to rotate around a circumference of the heating unit;

a hair holding unit attached movably to the one side of the rotation unit and in the lengthwise direction of the heating unit and configured to accommodate hair wound around the heating unit therein; and moving means for moving the hair holding unit in the lengthwise direction of the heating unit, wherein the moving means comprises:

a winding part disposed on one end portion of the body unit and configured to allow the one side of the rotation unit to rotate around the circumference of the heating unit; and a winding wire having one end connected to the hair holding unit and the other end fixed to the winding part via the one side of the rotation unit and being configured to be wound around the winding part as the rotation unit rotates and to move the hair holding unit in the lengthwise direction of the heating unit as the rotation unit rotates, wherein the rotation unit comprises a rotation member that is rotatably disposed on one end portion of the heating unit to rotate in the circumferential direction of the heating unit, and wherein the hair holding unit rotates with the rotation member in the circumferential direction of the heating unit and simultaneously moves along the lengthwise direction of the heating unit so that hair that is wrapped around the heating unit by the hair holding unit is wound along the lengthwise direction of the heating unit.

2. The hair curler according to claim 1, wherein the rotation unit comprises:

a support member detachably attached to the rotation member, allowing the hair holding unit to be attached thereto movably in the lengthwise direction of the heating unit, and rotating around the circumference of the heating unit and a circumference of a winding part, and wherein the moving means comprises:

the winding part disposed on one end portion of the body unit configured to allow the support member to rotate therearound, having two or more parts having different circumferential lengths from each other, and attaching a fastening part thereto so as to allow the fastening part to be movable in the lengthwise direction of the heating unit; and the fastening part for fastening the other end of the winding wire member thereto and attached to the winding part in such a manner as to be movable in the lengthwise direction of the heating unit.

* * * * *